US005662730A

United States Patent [19]

Akagi et al.

[11] Patent Number: 5,662,730

[45] Date of Patent: Sep. 2, 1997

[54] METHOD FOR PYROMETALLURGICAL SMELTING OF COPPER

[75] Inventors: Susumu Akagi; Takayoshi Fujii; Masatoshi Maeda; Yoshiaki Suzuki, all of Oita, Japan

[73] Assignee: Nippon Mining & Metals Co., Ltd., Tokyo, Japan

[21] Appl. No.: 567,839

[22] Filed: Dec. 6, 1995

[30] Foreign Application Priority Data

Dec. 8, 1994 [JP] Japan ..... 6-330439

[51] Int. Cl.[6] ..... C22B 15/00

[52] U.S. Cl. ..... 75/639; 75/640

[58] Field of Search ..... 75/639, 640

[56] References Cited

U.S. PATENT DOCUMENTS 4,857,104 8/1989 Victorovich et al. ..... 75/639

*Primary Examiner*—Melvyn Andrews

*Attorney, Agent, or Firm*—Kubovcik & Kubovcik

[57] ABSTRACT

In a flash smelting method of copper, a carbonaceous material, whose grain size is under 100 um and is in a proportion of 65% or more, and whose grain size is from 44 to 100 μm and is in a proportion of 25% or more, and which has 80% or more of a fixed carbon content, is charged into a reaction shaft of a flash smelting furnace. It is possible to prevent the excessive formation and excessive reduction of $Fe_3O_4$ in the slag. Copper loss, erosion of refractories and boiler trouble can be prevented.

11 Claims, 11 Drawing Sheets

PARTICLES OF
POWDER COKE

METHOD FOR PYROMETALLURGICAL SMELTING OF COPPER

BACKGROUND OF INVENTION

1. Field of Invention

The present invention relates to a pyrometallurgical smelting method of copper, and more particularly to an improvement of a method for charging the carbonaceous material into a flash smelting furnace which is utilized for the pyrometallurgical smelting of copper.

In the smelting operation of copper, a portion of Fe in the charged materials undergoes over-oxidation to form magnetite ($Fe_3O_4$) in the slag. This $Fe_3O_4$ deposits on the bottom or sidewall of the flash smelting furnace and acts as the protecting layer on the refractories of the furnace but, on the other hand, decreases the furnace's inner capacity. When the amount of $Fe_3O_4$ so formed becomes such that excessive growth of the coating is incurred, the coating may finally clog a tap hole for the slag and matte, so that the tapping operation is made difficult. In addition, a semi-molten solid layer, i.e., the so-called intermediate layer, is formed between the slag and matte layers in the furnace, thereby impeding separation of the slag and matte layers from one another. Furthermore, since the viscosity of the slag is increased by $Fe_3O_4$, the amount of copper suspended in the slag, and hence the waste amount of copper, increases. Various troubles as described above are incurred when magnetite is formed in a large amount. It is therefore important in the light of achieving effective and stable smelting operation of copper to suppress the amount of $Fe_3O_4$ to a very low level.

2. Description of Related Arts

It is a known process in the flash smelting of copper to blow powder coke with or without finely particulated coal together with copper concentrate and heavy oil into a flash smelting furnace so as to decrease the copper loss in the tapped slag and also to minimize fuel consumption (Japanese Unexamined Patent Publication No. 58-221,241). According to descriptions of this publication, since the metallurgical reactions suddenly occur in the oxidizing atmosphere of the flash-smelting furnace, a large amount of $Fe_3O_4$, which is a peroxide of iron, is formed and contained in the slag. The unburnt powder coke, which covers the slag, is therefore, caused to react with the magnetite and reduces it. The copper loss in the slag is decreased along with reduction of magnetite.

In addition, according to Japanese Unexamined Patent Publication No. 58-221,241 mentioned above, there are descriptions about the following preferred methods: the powder coke is added in the reaction shaft of a flash smelting furnace in such a manner that the entire surface of melt in the settler is uniformly covered with the unburnt powder coke; regarding the grain size of coke, since the degree of reduction of magnetite decreases when the grain size is ultra-fine, grain size is preferably from 16 mesh (1 mm) to 325 mesh (44 μm); and the carbonaceous material should have a high content of volatile matters.

Saganoseki Smelter, which belongs to the present Assignee, used, in a flash-smelting furnace, powder coke having the following distribution of grain sizes and attained from 2 to 4% of magnetite level in the slag. Also, consideration was given to the fact that the unburnt coke, which floats on the slag surface, reduces a portion of the magnetite ("Non-ferrous Smelting and Energy Saving" (1985) edited by Research Committee Concerning Non-ferrous Smelting Techniques and Energy. This Committee is organized under Japan Society for Mining and carried out research into the use of powder coke in a flash smelting furnace.

TABLE 1

| Kind of powder coke | | A | B | C |
|---|---|---|---|---|
| Distribution of grains | over 10 mm | 0 | 0 | 0 |
| | 5–10 mm | 6 | 6 | 5 |
| | 3–5 mm | 4 | 5 | 9 |
| | 1–3 mm | 16 | 25 | 21 |
| | 0.15–1 mm | 42 | 50 | 55 |
| | under 0.15 mm | 32 | 14 | 10 |
| | total | 100 | 100 | 100 |
| Components (%) | Free carbon | 85 | 85 | 85 |
| | Volatile matters | 1 | 1 | 2 |
| | Ash and others | 14 | 14 | 13 |
| Heat value (kcal/kg) | | 6,800 | 6,800 | 7,000 |

As described hereinabove, the process that is widely used at present in the copper smelting operation with the use of a flash-smelting furnace is to charge powder coke, finely particulated coal, finely particulated coke and the like into a reaction shaft for the purpose of reducing $Fe_3O_4$ and preventing troubles arising from the excessive formation of $Fe_3O_4$ described above. More specifically, although heavy oil, powder coke, finely particulated coal and the like have heretofore been charged into the reaction shaft of a flash-smelting furnace and burnt as a measure for heat compensation, a portion of the powder coke and finely particulated powder is not burnt in a reaction shaft and enters the melt formed at the bottom of the reaction shaft. $Fe_3O_4$ in the slag is then reduced by the unburnt coke. In other words, the powder coke and the like are added in the reaction shaft as a measure for heat compensation and also as an effective measure for reducing $Fe_3O_4$.

In a pyrometallurgical smelting method of copper with the addition of carbonaceous material, when the carbonaceous material is inadequately charged so as to result in the excessive reduction of magnetite, the coating on the furnace is diminished and the refractories are subjected to strong erosion. This causes such various drawbacks as: leak of melt from the furnace, formation of a metallic layer in the furnace, intrusion of metal into the masonry joints between bricks in the furnace bottom and hence causing upheaving of the bricks; partition of impurities into the metallic layer thereby lowering their distribution into the slag layer; and, transportation of the unburnt carbonaceous material upward to the waste-heat boiler where it is burnt, which seriously impedes the boiler operation.

As is explained in Japanese Unexamined Patent Publication No. 58-221,241 and the technical report by the smelter of the assignee, when the surface of the slag bath is covered by the unburnt powder coke, the amount of which is excessive from the view point of the intended purpose, it stagnates on the slag bath and drastically lowers the equilibrium partial pressure of oxygen. The thus formed highly reducing atmosphere in the furnace incurs in most cases such troubles as: disappearance of the coating on the furnace refractories and hence causing their erosion; upheaving of bricks due to intrusion of metal into bottom bricks; and decrease in the degree of impurity removal into the slag phase. The unburnt carbonaceous material generated in a large amount is transported together with gas into the waste-gas boiler and is later burnt there.

SUMMARY OF THE INVENTION

It is therefore an object of the present invention to resolve these contradictory aspects, namely, that the carbonaceous material, for example, powder coke, which is added into the reaction shaft of a flash smelting furnace, must be left unburnt to attain the effect of reducing $Fe_3O_4$, while a large amount of the unburnt carbonaceous material stagnating in the furnace causes the above described troubles. It is thus an object of the present invention to provide a pyrometallurgical smelting method of copper, which attains improved reduction effect and eliminates the above described various problems.

In accordance with the objects of the present invention, there is provided a pyrometallurgical smelting method of copper, characterized in that a carbonaceous material, whose grain size is under 100 μm and is in a proportion of 65% or more, and whose grain size is from 44 to 100 μm and is in a proportion of 25% or more, and which has 80% or more of fixed carbon content, is charged into a reaction shaft of a flash smelting furnace. The carbonaceous material is preferably the carbon powder which is generated and left unburnt when petroleum coke is burnt in a burner and then collected as dust. This carbonaceous powder is the so-called PC carbon. The present invention is hereinafter described with reference to powder coke which is an example of the carbonaceous material. It is to be understood that these descriptions are also applied to other carbonaceous materials.

The present inventors investigated and elucidated that the $Fe_3O_4$ in the slag is reduced by the unburnt coke under the following two mechanisms. (a) The powder coke, which floats and stagnates on the surface of the slag bath, decreases the oxygen partial pressure in the furnace and, therefore, the atmosphere in the furnace becomes strongly reducing. Consideration of this mechanism has previously been given. (b) While the powder coke intrudes into the slag and then floats on the surface of the slag, the powder coke is brought into contact with $Fe_3O_4$ and reduces it. This mechanism is hereinafter referred to as the "contact reduction". It turned out that the grain size of the powder coke greatly influenced which one of the two mechanisms (a) or (b) is more active than the other. When coarse powder coke approximately 100 μm or more in size is used, the grain size of the unburnt portion is large, so that the reaction speed of the contact reduction is very slow, and mechanism (a) predominates. On the other hand, the present invention proposes to refine the carbonaceous material as defined by the scope of claims. Then mechanism (b) becomes more active than mechanism (a), as described in detail hereinafter.

BRIEF DESCRIPTION OF DRAWINGS

One aspect of the present invention is to refine the grain sizes of powder coke more than in the prior art. First, consideration was given as to how the fine powder coke is burnt in a reaction shaft. The combustion speed of the carbonaceous material added in a reaction shaft is influenced by the oxygen partial pressure in the tower, temperature of coke particles, flow speed of gas and the like. How these parameters vary in the reaction shaft can be predicted based on a mathematical model, i.e, the flash-smelting furnace model as shown, for example, in FIG. 1. Since the copper concentrate, which is self-burning and charged together with the carbonaceous material, is in predominant amount compared with the other materials, the oxygen partial-pressure ($Po_2$) in the reaction shaft is ruled by combustion of the copper concentrate and drastically decreases toward the reactor bottom as shown in FIG. 1. In FIG. 1, $U_p/U_g$ is flow rate (U) ratio of particles/gas. $T_p$ is temperature (K) of particles. $t_p$ is the falling time (sec) of particles. With regard to three kinds of powder coke, whose distribution of grain size is shown in FIG. 2, their combustion behavior in a reaction shaft is considered. The distribution of grains sizes of the respective powder cokes is as follows.

TABLE 2

| | Under 100 μm | 100 μm–44 μm |
|---|---|---|
| Powder coke 1 | 78% | 63% |
| Powder coke 2 | 49% | 41% |
| Powder coke 3 | 7% | 5% |

Figure 1:
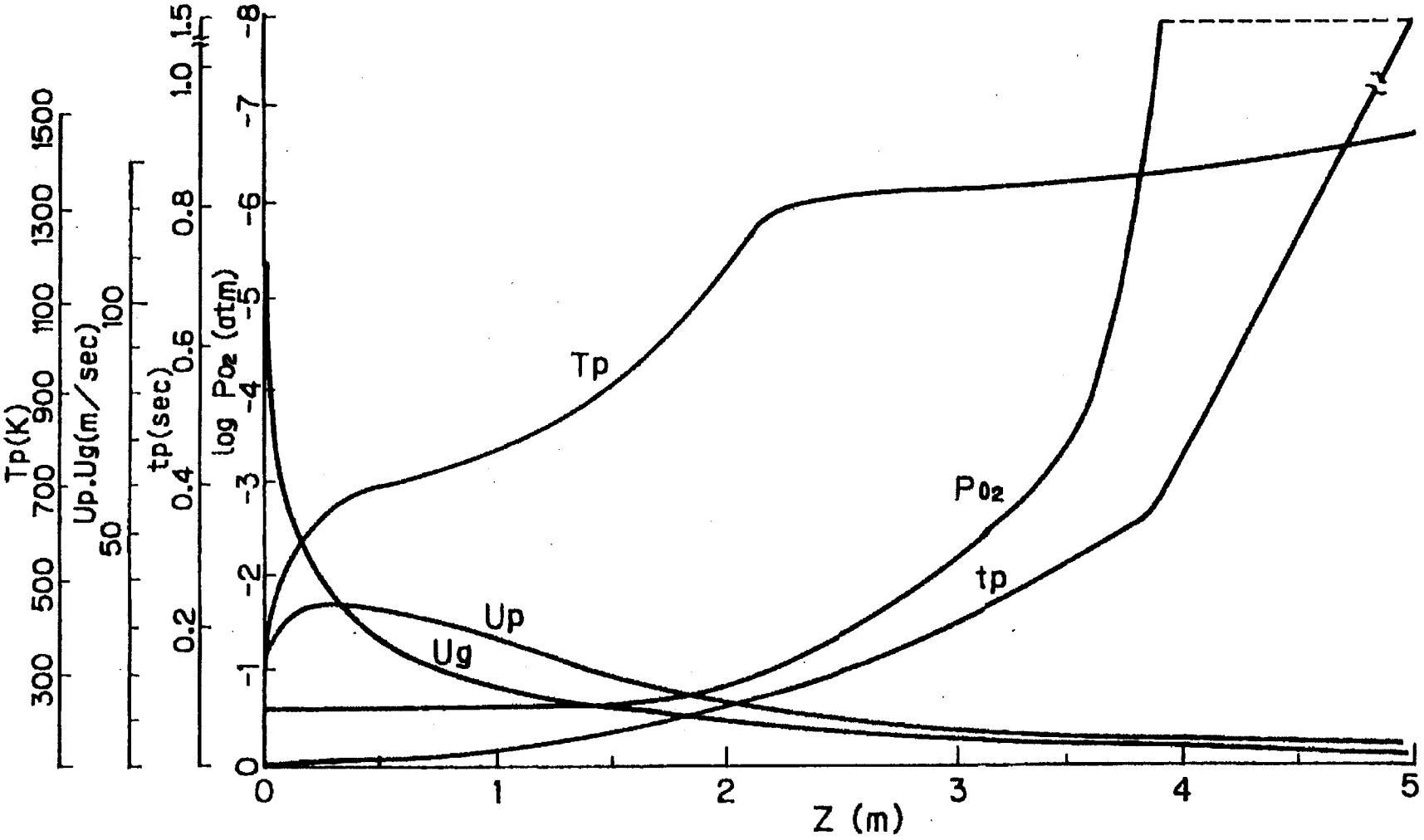
FIG. 1 is a graph showing the results of predicting how the respective parameters vary in a reaction shaft.
Figure 2:
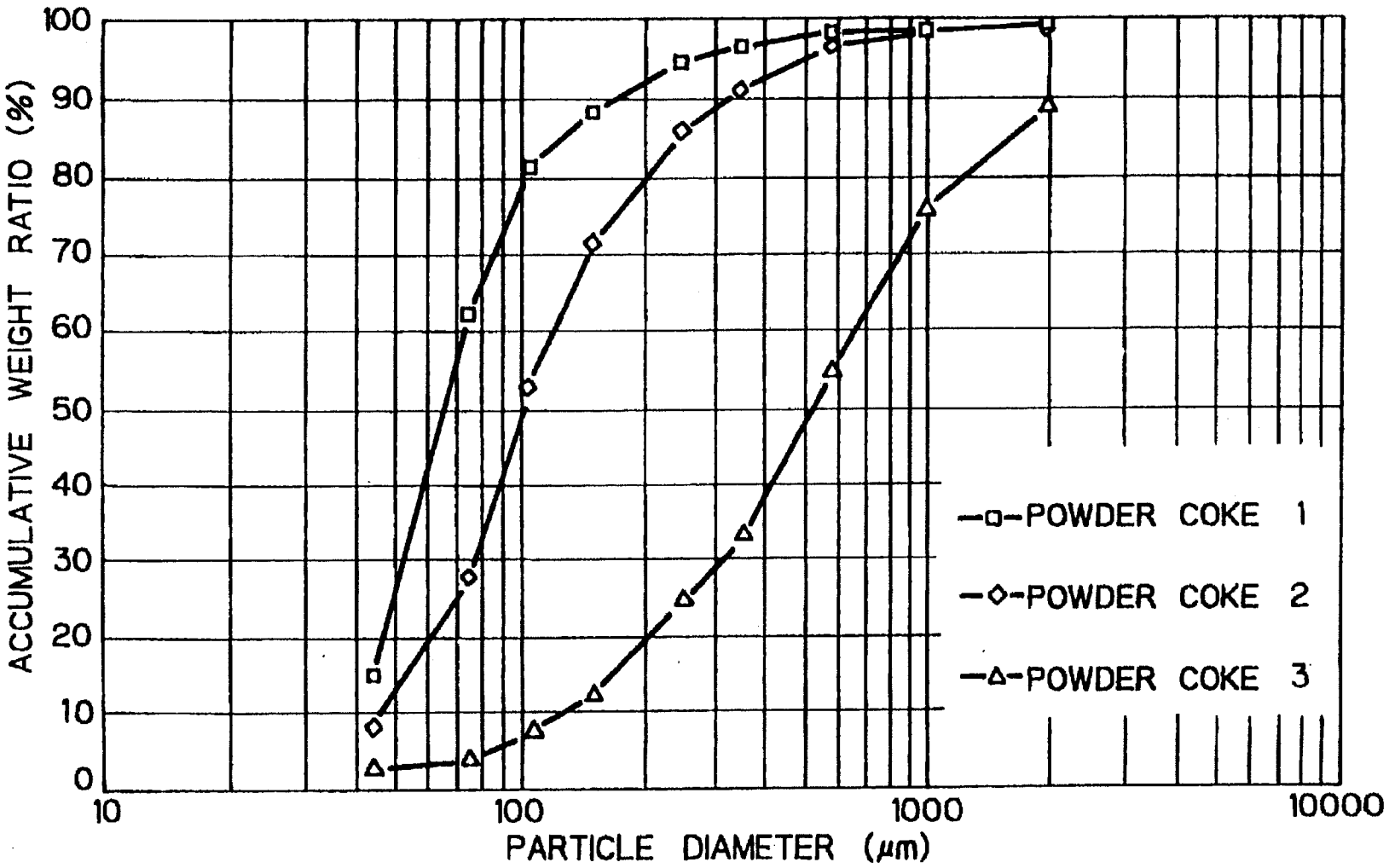
FIG. 2 is a graph showing the distribution of powder coke, obtained as a result of predicting the burning ratio.

The combustion ratio of the powder coke with three different grain-size distributions, as shown in FIG. 2, being burnt in a reaction shaft was predicted by the following calculation and on the basis of varying parameters as shown in FIG. 1. The results are shown in Table 3. The particle diameter of after-burning carbonaceous material can be calculated by the following formula.

$$r=r_0-(M_c/\rho_c)\times k_r\times C(O_2)\times\theta.$$

r: radius of the carbonaceous particle after burning (m)

$r_0$: initial radius of the carbonaceous particle (m)

$M_c$: molecular weight of carbon, 0.012 kg/mol $\rho_c$: density of the carbonaceous particles, 1000 kg/m$^3$ $k_r$: constant of total reaction rate (m/hr)

$C(O_2)$: oxygen concentration (mol/Nm$^3$)

θ: reaction time (hr)

The constant of total reaction rate was derived from the method described in Exercise of Smelting Chemical Engineering (written and edited by Iwao Muchi, Jan. 15, 1974, published by Yokendo, First Edition), pages 25 through 31, particularly pages 28 through 31. It is intended in this Exercise to predict by the above calculation method the combustion rate of a carbon particle during the sintering process. This method is based on the hypothesis that: the carbon is a single particle; the initial outer diameter of the carbon particle is maintained by the ash layer; and the diffusion resistance in the ash layer is negligible, i.e., only the diffusion resistance of the gas boundary film and the resistance of chemical reactions are taken into consideration. The hypothesis is considered to be practically reasonable also in the case of predicting combustion of carbon particles in a flash smelting furnace. The origin of the post burning radius (r) is also in the above Exercise, page 30.

TABLE 3

| Prediction Results of Combustion Ratio (%) of Powder Coke in a Reaction Shaft | | |
|---|---|---|
| | Calculated Value | Measured Value |
| Powder Coke 1 | 74 | 55–80 |
| Powder Coke 2 | 59 | 40–67 |
| Powder Coke 3 | 59 | 10–30 |

An aperture for sampling is provided in the lowest position of the side wall of a reaction shaft so as to collect the falling materials in the reaction shaft. The so-called samples of falling materials were analyzed with regard to the carbon content. The measured results are shown in Table 3, together with the calculated value. The two values are in good agreement. As is clear from Table 3, as the grain-size distribution of the charged powder coke is coarser, the combustion ratio is becomes lower, that is, the proportion of unburnt powder coke becomes greater. Since the calculation based on a model is good agreement with the measured value, consideration was given, relying on the mathematical model, to the grain-size distribution of powder coke, which is unburnt and remains in the furnace. The results are as shown in FIGS. 3 and 4.

Figure 3:
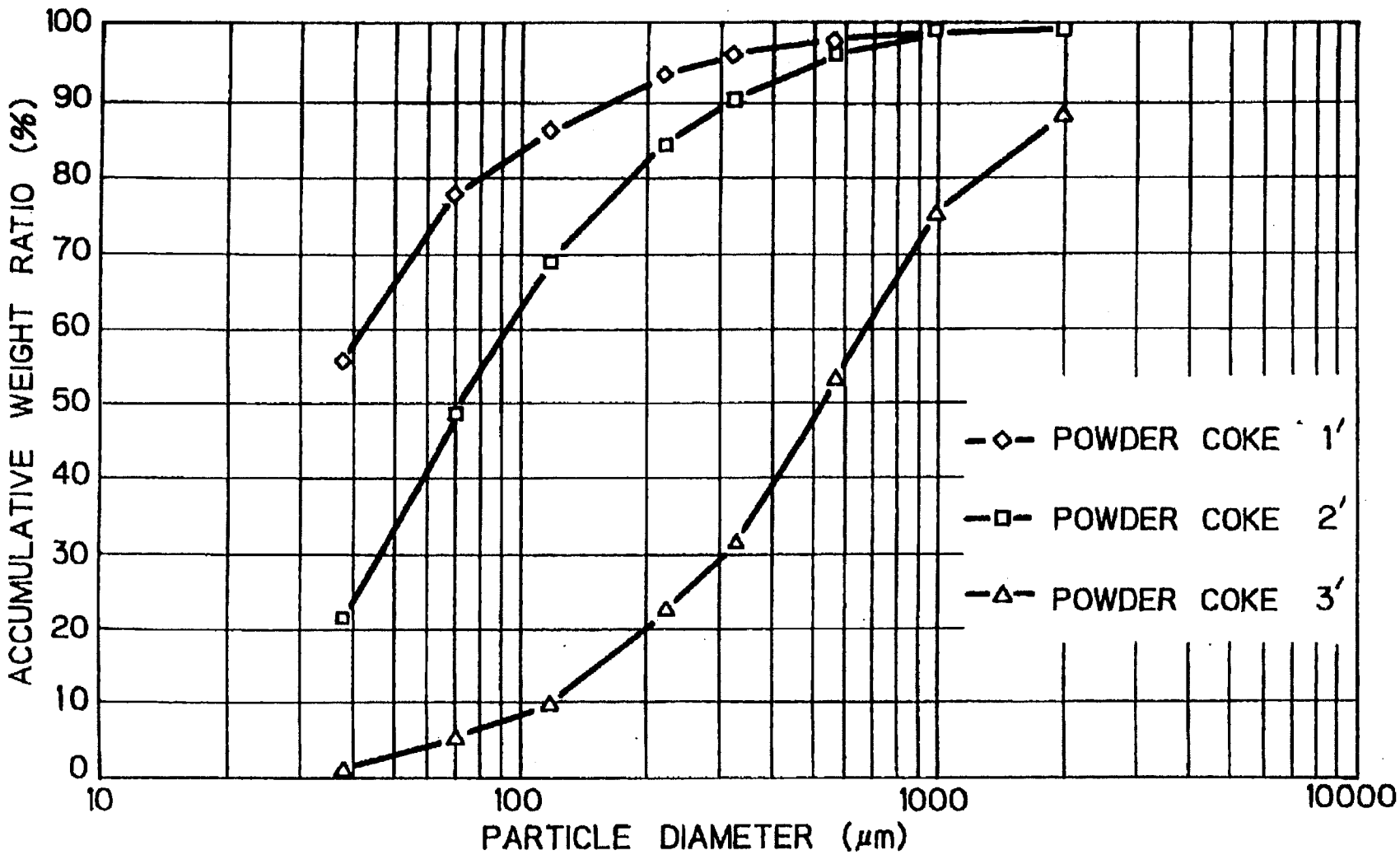
FIG. 3 is a graph showing the distribution of grain size of unburnt coke at the lowest portion of a reaction shaft.
Figure 4:
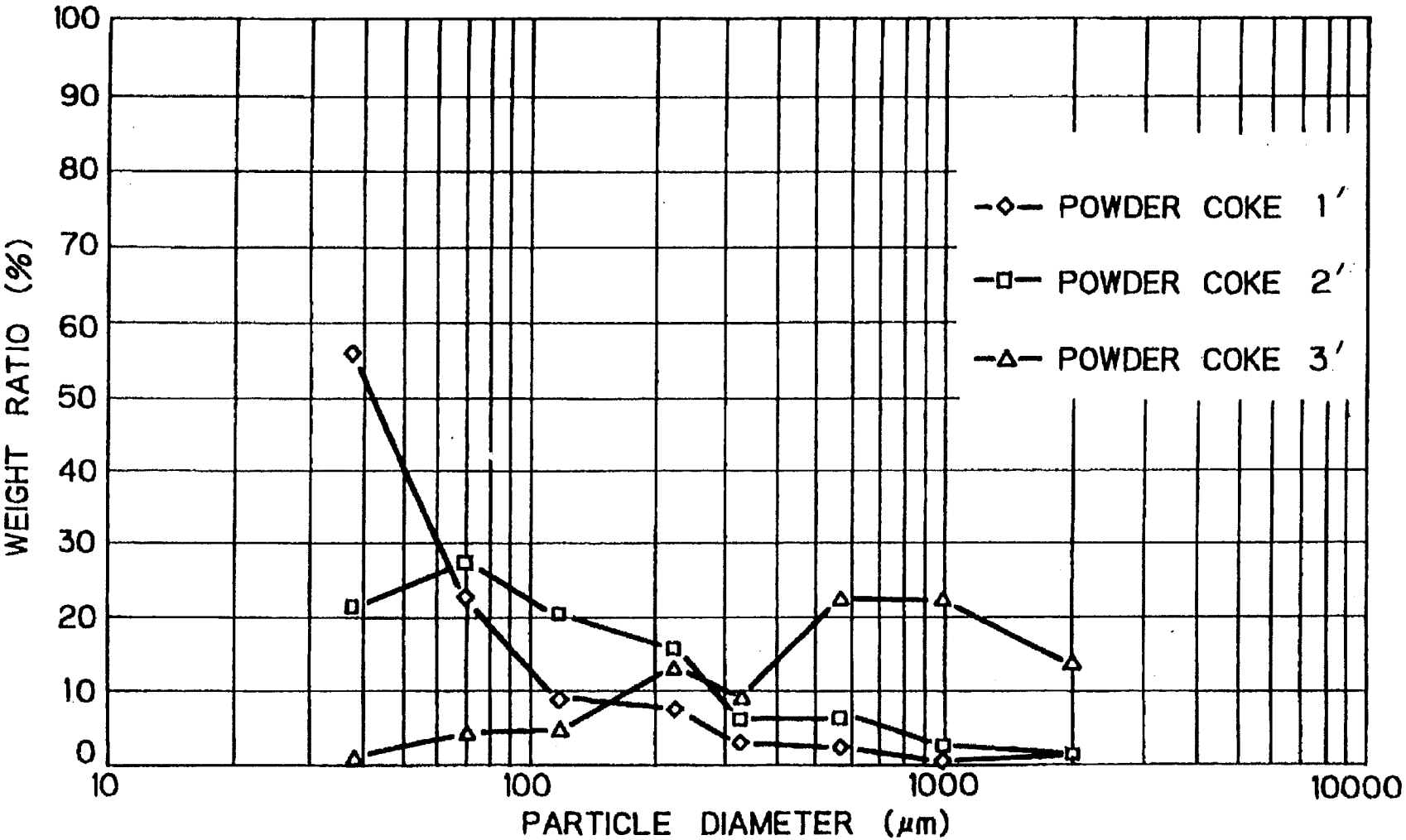
FIG. 4 is a graph showing the relationship of weight ratio versus the grain size of unburnt coke at the lowest portion of a reaction shaft.

FIGS. 3 and 4 show the accumulative weight ratio and weight ratio of the respective particles of the unburnt powder coke at the bottom of a reaction shaft, respectively.

The grain sizes of the three kinds of powder coke can be compared with one another at 50% of the accumulative weight ratio in FIG. 2 (before burning) and FIG. 3 (after burning, the cokes are denoted by the number with an apostrophe (')). The grain size, where the accumulative weight ratio is 50%, is 65 μm before burning and is approximately 35 μm after burning in the case of the powder coke 1. Similarly, in the case of powder coke 2, the variance in grain size due to burning is from 100 μm to 70 μm. However, in the case of powder coke 3, variation in the grain size is as coarse as 500 μm, the distribution of grain size virtually does not change due to burning.

Now referring to FIG. 4 which predicts how the weight ratio depends upon the grain size, the proportion of fine particles 40 μm or less increases up to 55% due to burning in the case of powder coke 1', which is twice or more as high as that of the powder coke 2'. In the case of powder coke 3', the proportion of coarse particles 300 μm or more is 70% or more.

As is described with reference to FIGS. 3 and 4, when the powder coke, which is finer than a certain particle-diameter, is burnt in a reaction shaft, the proportion of fine powder increases. The reduction ratio of magnetite can then be enhanced as is described hereinafter.

Figure 5:
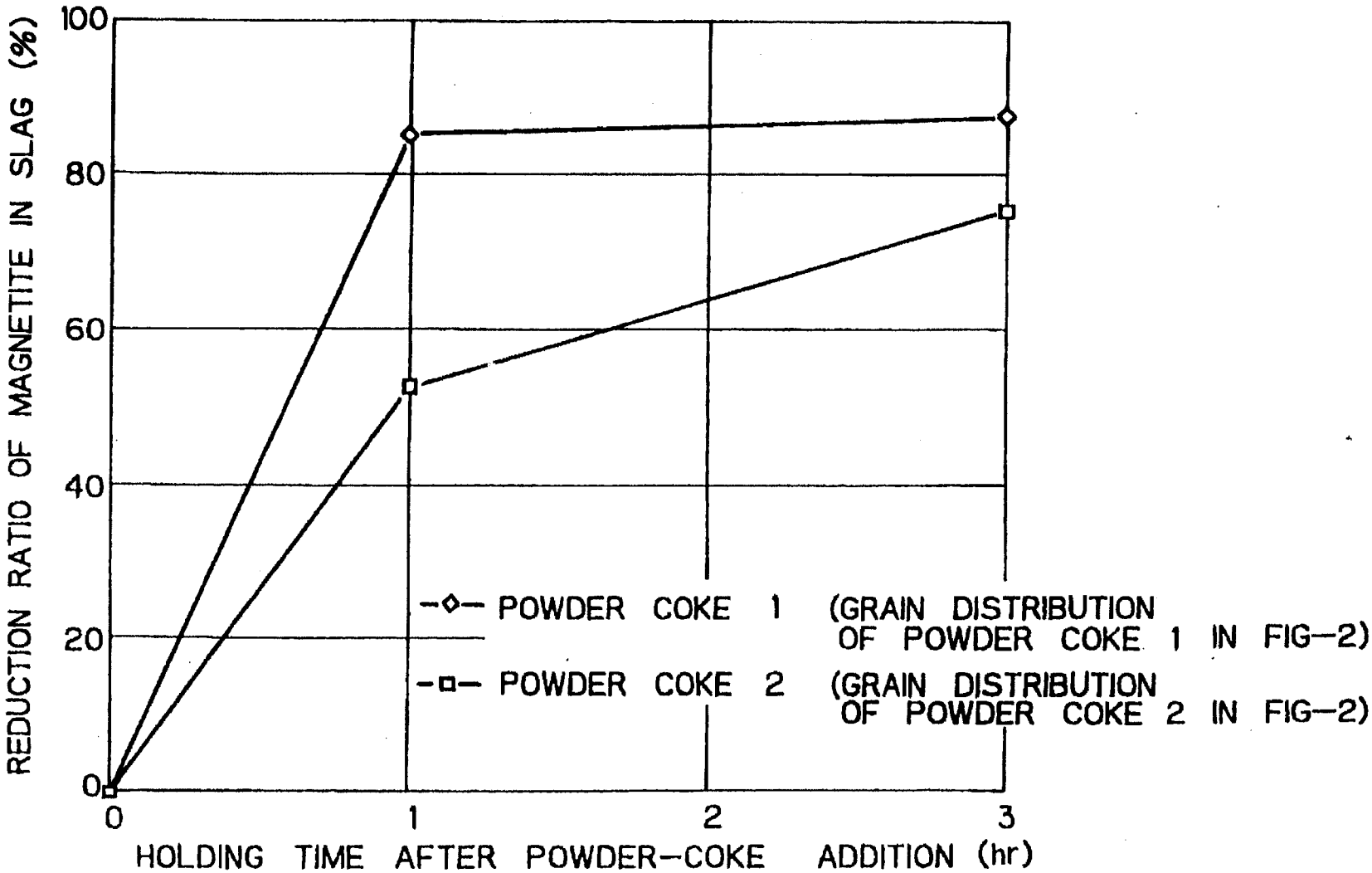
FIG. 5 is a graph showing the result of reduction of $Fe_3O_4$ in a crucible.
Figure 6:
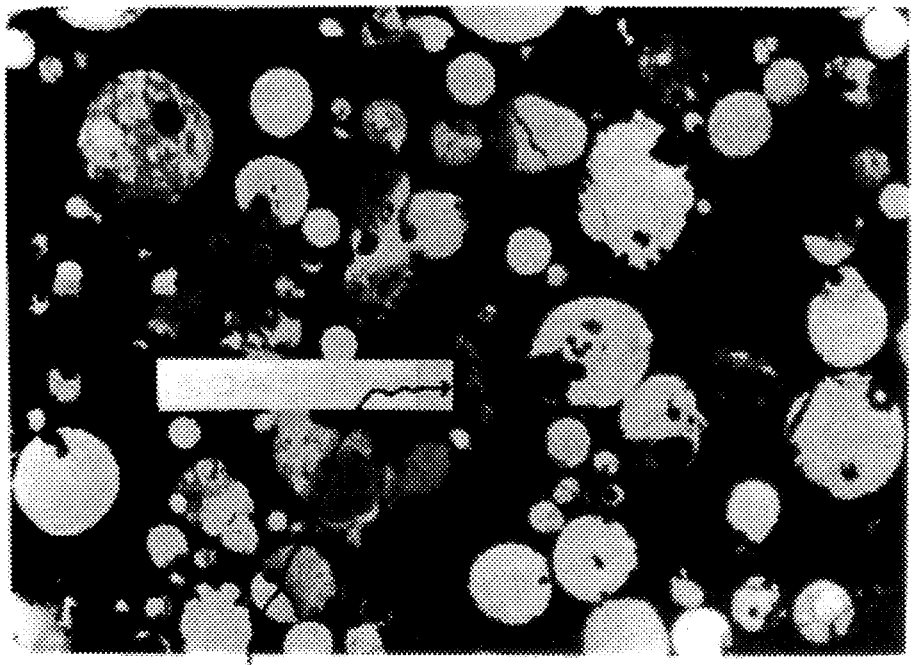
FIGS. 6 through 9 are optical microscopic photographs (magnified by 200) of the fallen materials a reaction shaft.
Figure 7:
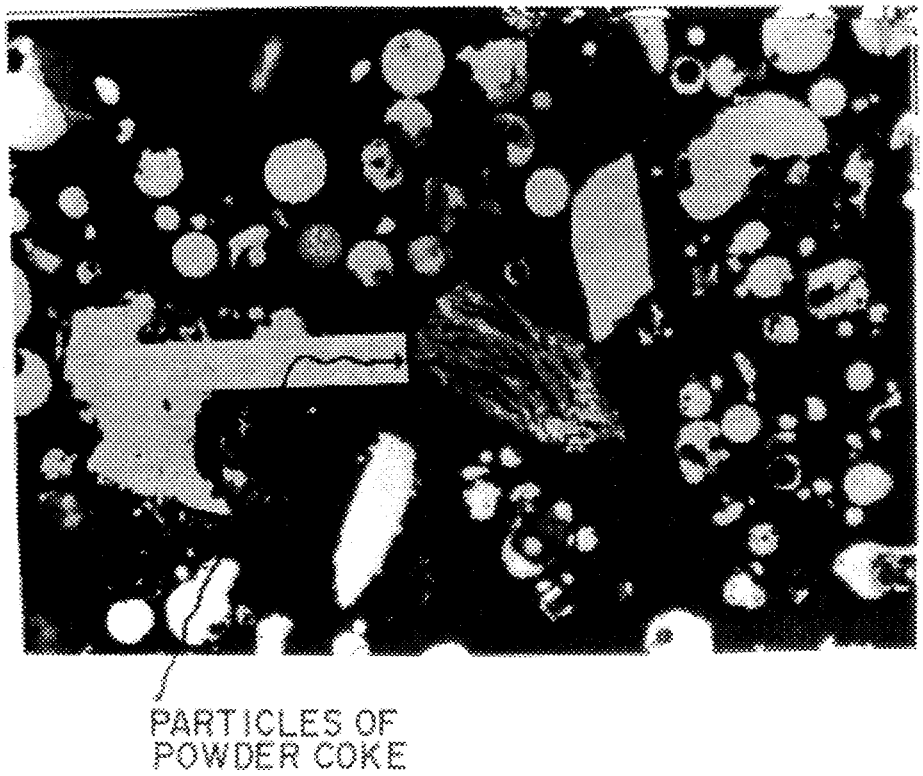
Figure 8:
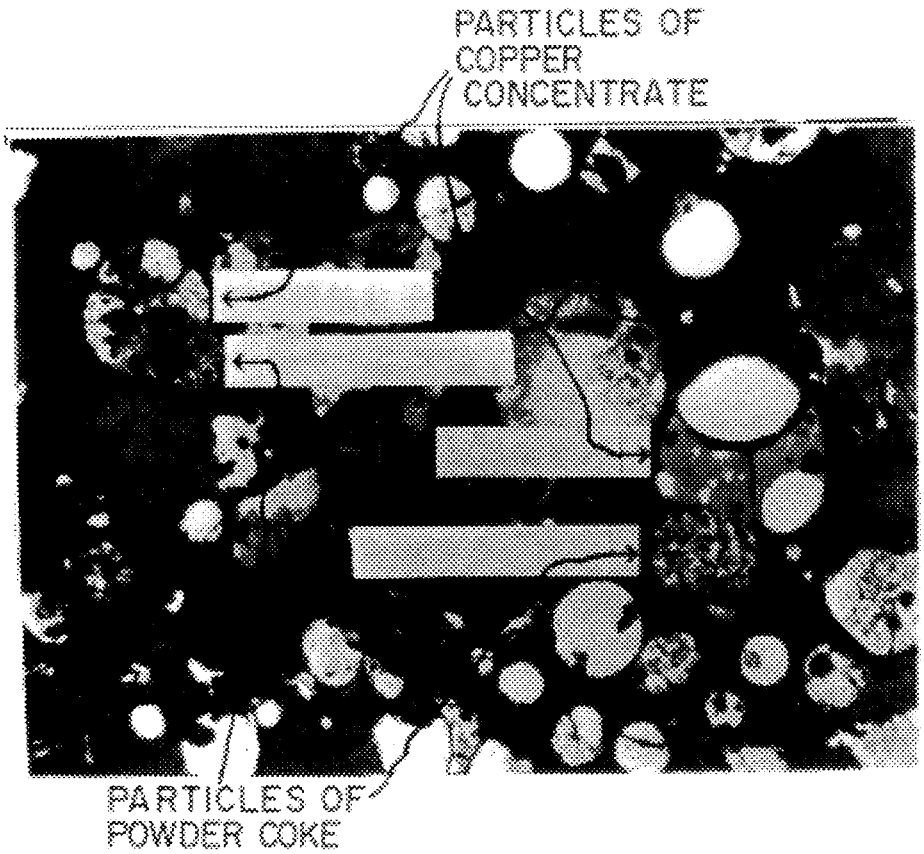
Figure 9:
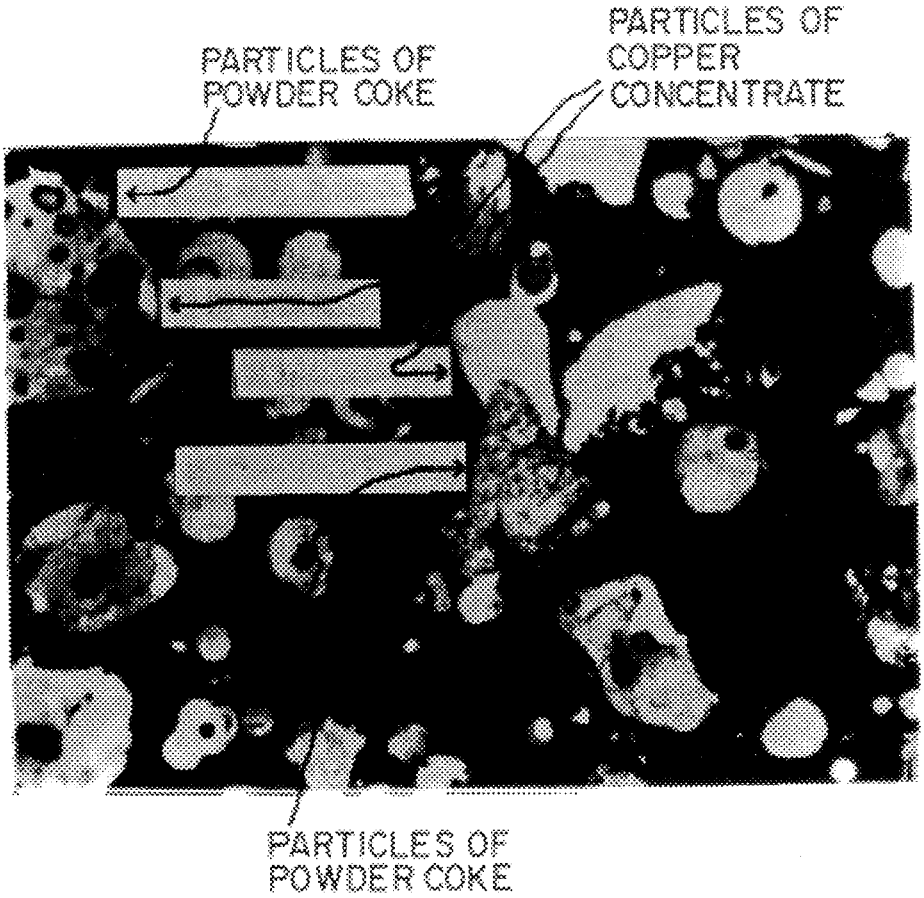

Powder coke was preliminarily adjusted by sieving to obtain a grain-size distribution of the powder cokes 1' and 2' shown in FIG. 3. The powder coke was then charged into a slag, which was melted in a crucible and adjusted to have a constant $Fe_3O_4$ content, in order to investigate the influence of the coke grain-size upon the reduction rate of $Fe_3O_4$. As is clear from FIG. 5, the powder coke 1' having finer grain size can attain a considerably higher reduction rate than the powder coke 2' having coarser grain size.

As a result of the experiments and considerations described above, it was discovered that: refining the grain size of unburnt coke, such as done in the powder coke 1, enhances the proportion of contact reduction according to mechanism (b) mentioned above; $Fe_3O_4$ in the slag can be effectively reduced by fine powder-coke, even if the amount that is charged is small; and, when fine powder coke is charged in a reaction shaft the unburnt powder coke can be suppressed to a very low level and virtually does not stagnate on the surface of the slag bath in the settler, and, therefore the various troubles described above arising from the excessive reduction of magnetite as well as trouble in the waste-heat boiler can be prevented.

These advantages were confirmed in a furnace operated in the Smelter of the Assignee as is described hereinafter. Experimental operations of the present invention were carried out and comparative examples were made, and the advantages of the present invention could be confirmed.

The grain size of the carbonaceous material used in the present invention is adjusted so that 65% or more, preferably 70% or more, is under 100 μm. More preferably, 80% or more is under 100 μm. When the proportion of the grain size from 100 μm to 44 μm is less than 25%, ultra-fine particles 44 μm or less increase and are burnt in the reaction shaft, thereby leaving essentially no unburnt powder coke. Therefore, the proportion of grains from 44 μm to 100 μm must be 25% or more, and more preferably from 40% or more.

Chemical analysis (%) of several commercially available powder cokes is given in the following table, which shows examples of the composition of carbonaceous material.

TABLE 4

| | Fixed carbon | Total sulfur | Volatile materials | Ash |
|---|---|---|---|---|
| Powder coke (Product of Company A) | 87.9 | 0.55 | 1.7 | 10.5 |
| Powder coke (Product of Company B) | 93.8 | 1.06 | 1.8 | 4.4 |
| Finely particulated coal (Product of Company C) | 47.2 | 2.36 | 42.7 | 9.0 |

Carbon in the carbonaceous material such as coke and finely particulated coal consists of fixed carbon and carbon in the volatile materials, as shown in Table 4. The latter is highly combustible and undergoes almost perfect combustion while falling down through the reaction shaft. Since the carbon in the volatile materials therefore does not remain as the unburnt portion, the carbon contained in the volatile materials is appropriate as a fuel but not as the reducing agent.

The carbonaceous material having preferably higher content of fixed carbon and lower content of volatile materials is more appropriate as the reducing agent which is charged into a reaction shaft. Particularly, when the oxygen concentration of the air blast blown into a flash smelting furnace is raised to increase the feeding rate of copper concentrate, in order to increase the productivity, the amount of auxiliary fuel required for heat compensation decreases. If the finely particulated coal with high concentration of volatile materials is used as the reducing agent in this situation, since such coal is highly combustible, the amount of unburnt carbon drastically decreases, so that almost no reduction effect of magnetite is attained by the unburnt carbon. For example, when the finely particulated coal, which contains approximately 40% each of volatile materials and fixed carbon, and which has approximately 90 μm or less of the grain size, is charged in the reaction shaft, almost complete combustion occurs, so that virtually no unburnt portion required for the reduction is left. When the powder coke and the finely particulated coal are compared with one another from this point of view, since the volatile materials are as low as from 1 to 5% and the fixed carbon is as high as 80 to 95% in the former, while the latter contains from 30 to 40% of the volatile materials and the fixed carbon is from 40 to 70% and hence low, the powder coke is preferred to the finely particulated coal. The fixed carbon must be 80% or more, more preferably 90% or more.

The carbonaceous material can be charged into a reaction shaft of a flash smelting furnace by means of preliminarily mixing the same with the main charging material, such as copper concentrate or fluxing agent, and then feeding through the concentrate burners. A burner for exclusively charging the carbonaceous reducing agent can be installed on the top of a reaction shaft. The carbonaceous material is added preferably from 0.5 to 2%, more preferably from 0.8 to 1.2% based on the total changing materials.

Figure 11:
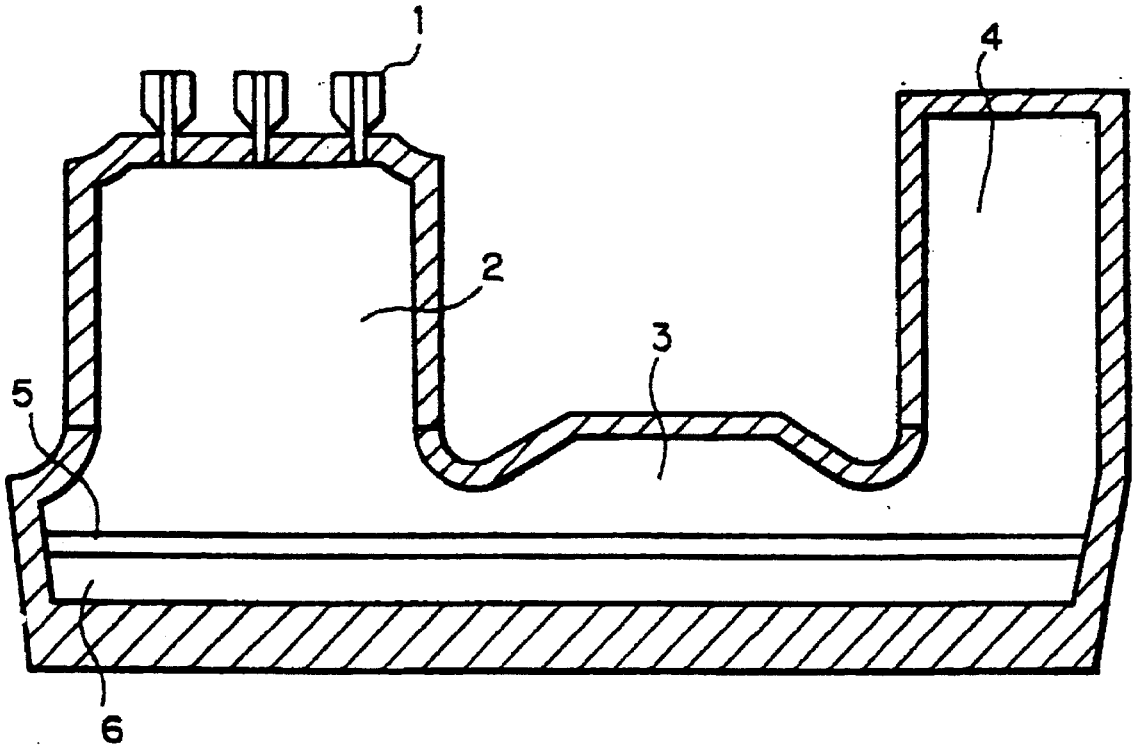
FIG. 11 shows dimensions of the flash smelting furnace in the examples.

The flash-smelting furnace may be an Autokump type as shown in FIG. 11, Inco-type or any other type. Various copper concentrates can be used, provided that the copper concentrates contain such an amount of sulfur as to enable flash smelting and contains mainly copper as the valuable metal.

More theoretical aspect of the present invention are described.

It is mathematically predicted that unburnt powder coke with approximately 250 μm or less of particle diameter is carried over into a boiler under the ordinary operating conditions of a flash smelting furnace. It seems that the unburnt powder coke with finer grain size can be more easily carried. Nevertheless, the result is contrary. Research into the cause of this result revealed the following interesting phenomena.

An aperture for sampling was made in the lowest portion of the side wall of a reaction shaft of a flash-smelting furnace, with which experimental operations were carried out. The fallen materials in the reaction shaft were collected through the aperture, and were embedded in resin to prepare a sample, whose cross-section was cut and polished for observation by an optical microscope (magnified by 200). As is revealed from these photographs in FIGS. 6 through 9, a major portion of the relatively fine, unburnt powder coke impinges on and is captured by the particles of copper concentrate, which are melted by the reaction heat. That is, the probability the unburnt powder coke impinging on the copper concentrate is high. The probability of capturing the unburnt powder coke by the melted copper concentrate is also high. This is the reason that the unburnt powder coke is not carried over. In addition, the unburnt powder coke passes across the surface of the slag bath and settles in the slag bath, and subsequently floats. During this process, the unburnt powder coke is brought into contact with $Fe_3O_4$, which is thus reduced by the contact reduction.

When the grain size of powder coke lies outside the present invention and becomes coarse, the probability of impinging between the powder coke and the copper concentrate particles is lowered, so that the proportion of powder coke being carried over into a boiler relatively increases.

In addition to the phenomena described above, it turned out that As and Sb in the matte transport satisfactorily into the slag and, further, the unburnt powder coke does not incur such excessive reduction that the distribution ratio of these elements into slag is detrimentally lowered.

The present invention is described hereinafter in detail by way of Examples.

EXAMPLE 1

Figure 10:
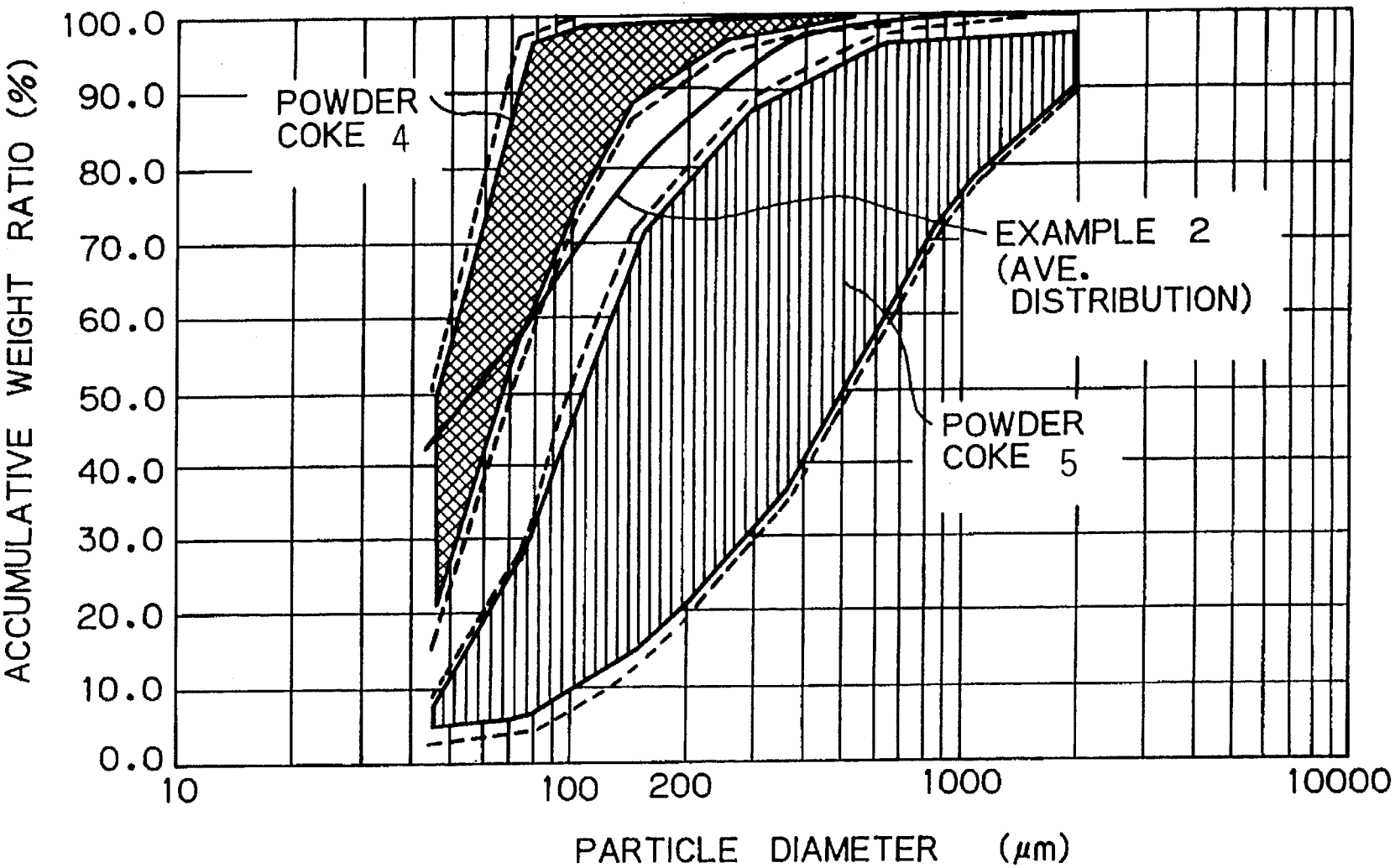
FIG. 10 is a graph showing the distribution of grain sizes of the powder coke used in the examples.

The powder coke 4 (the so-called PC carbon), whose distribution of grain size is shown in FIG. 10, was charged into the reaction shaft 2 of a flash-smelting furnace shown in FIG. 11 through a concentrate burner 1. The powder coke 4 amounted to 0.9% of the charged materials. In FIG. 17, 3 is a settler, 4 is an uptake, 5 is slag and 6 is matte.

The experimental operations revealed the following results. The $Fe_3O_4$ content in the slag, which is an index of the reduction effect, was from 3 to 6%. No intermediate layer was formed. The quality of Cu in the slag was 0.60%. The distribution ratios of As and Sb between the slag and matte were 0.5 and 1, respectively. The distribution ratios herein are defined by:

Distribution ratios of As=$(As)_{slag}/[As]_{matte}$

Distribution ratios of As=$(Sb)_{slag}/[Sb]_{matte}$, wherein (As), [As], (Sb) and [Sb] are in weight percentage.

In the experimental operations, charging of the raw materials was interrupted. Immediately after the interruption, a portion of the slag was sampled from the surface layer of slag in the settler, directly beneath the reaction shaft and from a slag launder. The carbon and $Fe_3O_4$ contents (%) of the collected slag were measured. The results are shown in Table 5.

TABLE 5

| Position of slag sampling | C | $Fe_3O_4$ |
|---|---|---|
| Settler directly beneath the reaction shaft | 0.14 | 4.60 |
| Slag launder | 0.02 | 4.19 |

The results in Table 5 indicate that the slag directly beneath the reaction shaft contains unburnt coke in an amount corresponding to 0.14% of carbon and, further, $Fe_3O_4$ in the slag is in the order of 4% as a result of reduction.

Observation of the furnace inside revealed that there was almost no unburnt coke floating and stagnating on the slag bath in the settler. After-burn in the burner, which is an index of trouble in the operation, did not occur at all. The coating on the refractories of the settler was kept considerably thin as compared with Comparative Example 2 but covered uniformly the entire surface of the refractories. CO was not detected in the waste gas.

COMPARATIVE EXAMPLE 1

The powder coke 5, whose distribution of grain size is shown in FIG. 10, was added to the charging materials, such as copper concentrates and fluxing agent, and was charged into the reaction shaft 2 of a flash-smelting furnace shown in FIG. 11 through a concentrate burner 1. The powder coke 5 amounted to 1.5–2.3% of the charged materials.

The experimental operations revealed the following results. The $Fe_3O_4$ content in the slag was from 2 to 5% and hence lower than in Example 1. No intermediate layer was formed. However, the coating layer of the refractories became so thin that the bricks were locally exposed and brought into direct contact with the melt.

The distribution ratios of As and Sb between the slag and matte were 0.25 and 0.5, respectively. These values are as small as approximately one quarter of those without addition of carbonaceous material. The transportation of these elements in the slag was therefore lowered.

The unburnt powder coke was carried over into a boiler and after-burnt, thereby considerably impeding the dust collection. When the charging of raw materials was interrupted and then the furnace inside was observed, a large amount of the unburnt coke floated and stagnated on the surface of melt in the settler.

COMPARATIVE EXAMPLE 2

Powder coke, whose grain size was the same as in Comparative Example 1 (powder coke 5 in FIG. 10), was charged into the reaction shaft of a flash smelting furnace through the concentrate burner. The powder coke amounted to 0.9% of the charged materials.

The $Fe_3O_4$ content of the slag was from 7 to 10% and was thus high compared with that of Comparative Example 1. An intermediate layer from 100 to 200 mm thick was formed between the slag and matte. The Cu content in the slag (slag loss) was higher than in Comparative Example 1 by approximately 0.05%. Meanwhile, the refractories of the settler were coated by the coating layer on the entire surface. The distribution ratios of As and Sb between the slag and matte were approximately, 0.5 and 1, respectively, which were twice as high those of Comparative Example 1.

The after-burn trouble of unburnt powder-coke in the boiler almost did not occur. However, powder coke of the grain size as shown for the right-hand portion of powder coke 5 in FIG. 10 still led to troubles in the boiler.

Observation of the furnace inside revealed that the unburnt coke, which floats and stagnates on the surface of the slag bath in the settler decreased considerably as compared with Comparative Example 1. The unburnt coke did not cover the entire surface of the slag bath.

The test results of Example 1 and Comparative Examples 1 and 2 are shown in Table 6 in a comparative method.

TABLE 6

| Test Conditions | Example 1 | Comparative Example 1 | Comparative Example 2 |
|---|---|---|---|
| Carbonaceous material | | | |
| Kind | Powder coke 4 | Powder coke 5 | Powder coke 5 |
| Addition amount (%) | 0.9 | 1.5–2.3 | 0.9 |
| Copper content in matte (%) | 60–61 | 60–61 | 60–61 |
| Test Conditions | | | |
| $Fe_3O_4$ in slag (%) | 3–6 | 2–5 | 7–10 |
| Thickness of intermediate layer (mm) | none | none | 100–200 |
| Partition coefficient between slag and matte As | 0.5 | 0.25 | 0.5 |
| Sb | 1 | 0.5 | 1 |
| Cu loss in slag (%) | 0.60 | 0.60 | 0.65 |
| Coating on refractories | uniform | local exposure of refractories | uniform and thick |
| Influence on the boiler | no after-burn | after-burn, operation impeded | almost no after-burn |

EXAMPLE 2

Smelting of copper was carried out in the flash smelting furnace by the same method as in Example 1 except that the powder coke (fixed carbon: 81.6%) had a distribution of grain size as shown in FIG. 10 and also below, and proportion of further addition of powder coke was 0.9%.

| Grain Size (μm) | Accumulative weight ratio (%) |
|---|---|
| +250 | 100 |
| 250/150 | 90 |
| 150/105 | 79 |
| 105/75 | 69 |
| 75/44 | 57 |
| −44 | 43 |
| (100 − 44) | 26 |

As a result of smelting, the unburnt carbonaceous material floated on the surface of the slag bath, but its amount was less than in the Comparative Examples. No troubles occurred in operation. The carbonaceous material exhibited satisfactory and virtually the same reducing ability as in Example 1.

We claim:

1. A method for pyrometallurgical smelting of copper, comprising providing a flash smelting furnace having a reaction shaft;

charging a concentrate into the furnace, said concentrate containing copper, iron and an amount of sulfur sufficient to enable flash smelting of copper to occur, thereby forming a matte and a slag in said flash smelting furnace;

charging a carbonaceous material in said reaction shaft, wherein said carbonaceous material comprises at least 80% by weight fixed carbon content, and said carbonaceous material is in the form of grains, such that a proportion of said grains having a grain size of less than 100 μm is at least 65%, and a proportion of said grains having a size of 44 to 100 μm is at least 25%;

burning a part of the carbonaceous material in the reaction shaft;

incorporating another part of the carbonaceous material in the slag, such that almost no floating layer of the carbonaceous material is formed on the slag.

2. A pyrometallugical smelting method according to claim 1, wherein said carbonaceous material is coke.

3. A pyrometallurgical smelting method according to claim 1, wherein the proportion of under 100 μm of grain size is 80% or more.

4. A pyrometallurgical smelting method according to claim 3, wherein the proportion of from 44 to 100 μm of grain size is 40% or more.

5. A pyrometallurgical smelting method according to claim 4, wherein the fixed carbon is 90% or more.

6. A pyrometallurgical smelting method according to claim 1, wherein the carbonaceous material is charged in an amount from 0.5 to 2% based on the weight of the charged concentrate.

7. A pyrometallurgical smelting method according to claim 2, wherein the proportion of under 100 μm grain size is 80% or more.

8. A pyrometallurgical smelting method according to claim 7, wherein the proportion of from 44 to 100 μm of grain size is 40% or more.

9. A pyrometallurgical smelting method according to claim 2, wherein the carbonaceous concentrate is charged in an amount from 0.5 to 2% based on the weight of the charged materials.

10. A pyrometallurgical smelting method according to claim 4, wherein the carbonaceous concentrate is charged in an amount from 0.5 to 2% based on the weight of the charged materials.

11. A pyrometallurgical smelting method according to claim 5, wherein the carbonaceous concentrate is charged in an amount from 0.5 to 2% based on the weight of the charged materials.

* * * * *